US008607982B2

(12) United States Patent
Jones

(10) Patent No.: US 8,607,982 B2
(45) **Date of Patent: *Dec. 17, 2013**

(54) CHILD RESISTANT BLISTER PACKAGE HOUSING WITH TOOLED ACCESS

(75) Inventor: Steve P. Jones, Elon, NC (US)

(73) Assignee: MeadWestvaco Corporation, Richmond, WA (US)

( * ) Notice: Subject to any disclaimer, the term of this patent is extended or adjusted under 35 U.S.C. 154(b) by 175 days.

This patent is subject to a terminal disclaimer.

(21) Appl. No.: 13/044,436

(22) Filed: Mar. 9, 2011

(65) Prior Publication Data

US 2011/0210036 A1 Sep. 1, 2011

Related U.S. Application Data

(63) Continuation-in-part of application No. 12/259,025, filed on Oct. 27, 2008, now Pat. No. 7,926,660.

(60) Provisional application No. 60/982,977, filed on Oct. 26, 2007.

(51) Int. Cl.
*B65D 85/04* (2006.01)

(52) U.S. Cl.
USPC ..... 206/531; 206/532

(58) Field of Classification Search
USPC ..... 206/528, 531, 534, 538, 539, 469, 532
See application file for complete search history.

(56) References Cited

U.S. PATENT DOCUMENTS

| | | | | |
|---|---|---|---|---|
| 4,330,079 | A | 5/1982 | Wood | |
| 4,411,370 | A | 10/1983 | Rausing | |
| 4,925,034 | A | 5/1990 | Robichaud et al. | |
| 5,339,960 | A * | 8/1994 | Price | 206/531 |
| 5,655,661 | A | 8/1997 | Rigby | |
| 5,944,191 | A | 8/1999 | Ray et al. | |
| 6,659,280 | B2 | 12/2003 | Paliotta et al. | |
| 6,675,972 | B2 | 1/2004 | Patterson | |
| 6,951,282 | B2 | 10/2005 | Jones | |
| 7,401,702 | B2 | 7/2008 | Hession | |
| 7,607,539 | B2 | 10/2009 | Freeze | |
| 7,726,485 | B2 | 6/2010 | Brollier | |
| 7,926,660 | B2 * | 4/2011 | Jones et al. | 206/531 |
| 2004/0188312 | A1 | 9/2004 | Stepowany | |
| 2007/0084747 | A1 | 4/2007 | Gherdan et al. | |
| 2007/0221534 | A1 | 9/2007 | Intini | |
| 2009/0188832 | A1 | 7/2009 | Pham | |
| 2009/0242451 | A1 | 10/2009 | Kessler | |
| 2009/0308775 | A1 | 12/2009 | Hession et al. | |
| 2010/0243507 | A1 | 9/2010 | Gelardi et al. | |

FOREIGN PATENT DOCUMENTS

| | | |
|---|---|---|
| WO | WO2007033004 | 3/2007 |

* cited by examiner

*Primary Examiner* — David Fidei
(74) *Attorney, Agent, or Firm* — MWV Intellectual Property Group

(57) ABSTRACT

A packaging blank includes a first panel and a second panel. The first panel defines at least one blister aperture and at least one tool portion. The second panel defines at least one tab strip and at least one tool access portion. The at least one tab strip is at least partially severable from the packaging blank. The at least one tool access portion is substantially completely severable from the packaging blank. The first panel and the second panel are configured to be positioned relative to one another in a face contacting arrangement such that a first portion of a given tool portion is to be operably aligned with a corresponding tool access portion. As such, the first portion of the given tool portion thereby is capable of being accessed by a tool via the corresponding tool access portion.

20 Claims, 20 Drawing Sheets

CHILD RESISTANT BLISTER PACKAGE HOUSING WITH TOOLED ACCESS

CROSS-REFERENCE TO RELATED APPLICATIONS

This application is a Continuation-In-Part application of U.S. Ser. No. 12/259,025, filed Oct. 27, 2008, which claims the benefit of U.S. Provisional Application No. 60/982,977, filed Oct. 26, 2007, each of which is incorporated herein by reference in their entirety.

TECHNICAL FIELD

The present invention relates generally to child resistant blister packaging for the packaging and dispensing of articles. More specifically, the present invention is directed to a package including a child resistant blister package housing for encapsulating one or more blister packages and allowing controlled and child-resistant packaging and dispensing of articles

BACKGROUND

It is known that blister packaging can be used to store and deliver a wide range of items. Among the many types of items that can be stored and delivered in blister packs are pharmaceutical products, such as tablets, pills, capsules, and other related items. Conventional blister packages include a blister tray that is typically a thermoformed plastic sheet with a plurality of blister cells or depressions formed therein. Typically, after items are placed in the cells, the items are retained and protected in the respective cells by securing a backing sheet to the blister tray. The backing sheet is often a thin layer of metal foil, plastic, paperboard, or other material secured to the back of the blister tray, thereby sealing the cells. In other types of blister packages, the contents are placed in substantially puncture-proof foil containers that can be covered with foil or paperboard backing.

In many blister packages, the foil backing is thin enough to be punctured mechanically, or ruptured by pressing the blister so that the encapsulated item penetrates the foil backing. If the backing sheet is made from, for example, paperboard, or similar material, then the backing often includes gates in the backing sheet that covers the openings of respective blister cells. In practice, each gate is deformed or manipulated so that it ruptures or partially separates from the surrounding paperboard to allow the item contained within the blister cell to be pushed out of the blister cell for use.

While the conventional blister packaging is viewed by many to be suitable for most applications, there are several design deficiencies. The conventional packages provide removal of the items from the blister cells, but offer little in the way of resisting child tampering. Child resistance is a feature that is desired, particularly for dose pharmaceutical packaging.

To address the desirability of child resistance, many blister packaging designs employ materials of increased rigidity, compared to conventional non-child-resistant packages. For example, in increased-rigidity packages, the backing sheet and/or the blister cells can be made thicker and/or more resistant to pressure. As such, a young child is unlikely to be able to generate the pressure required to force the package contents through the increased-strength materials. In addition to the benefits in terms of child-resistance, increased rigidity can provide additional protection for the enclosed materials, which may be, as is the case with pharmaceuticals, fragile and susceptible to breakage.

DESCRIPTION

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as an illustration, specimen, model or pattern. As used herein, the terms "foldable score line" and "severance line" refer to all manner of lines indicating optimal fold or cut locations, frangible or otherwise weakened lines, perforations, a line of perforations, a line of short slits, a line of half-cuts, a single half-cut, a cut line, scored lines, slits, any combination thereof, and the like.

The figures are not necessarily to scale and some features may be exaggerated or minimized to show details of particular components. In other instances, well-known components, systems, materials or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

It is contemplated that the present invention is not limited to the pharmaceutical and personal healthcare related articles referenced with the illustrated embodiment. Instead, embodiments of packaging made in accordance with the present invention can have application in packaging for any small, delicate, sensitive, or portable article. Furthermore, the packaging can be used for larger items as a method of decreasing the incidence of product theft. Examples of articles for which such packaging can be employed include all manner of consumable products such as candy, food, vitamins, tobacco, and the like; all manner of personal care products such as contact lens, birth control devices, smoking cessation patches, hearing aid batteries, and the like; as well as any item that can fit within a portable container.

Figure 1:
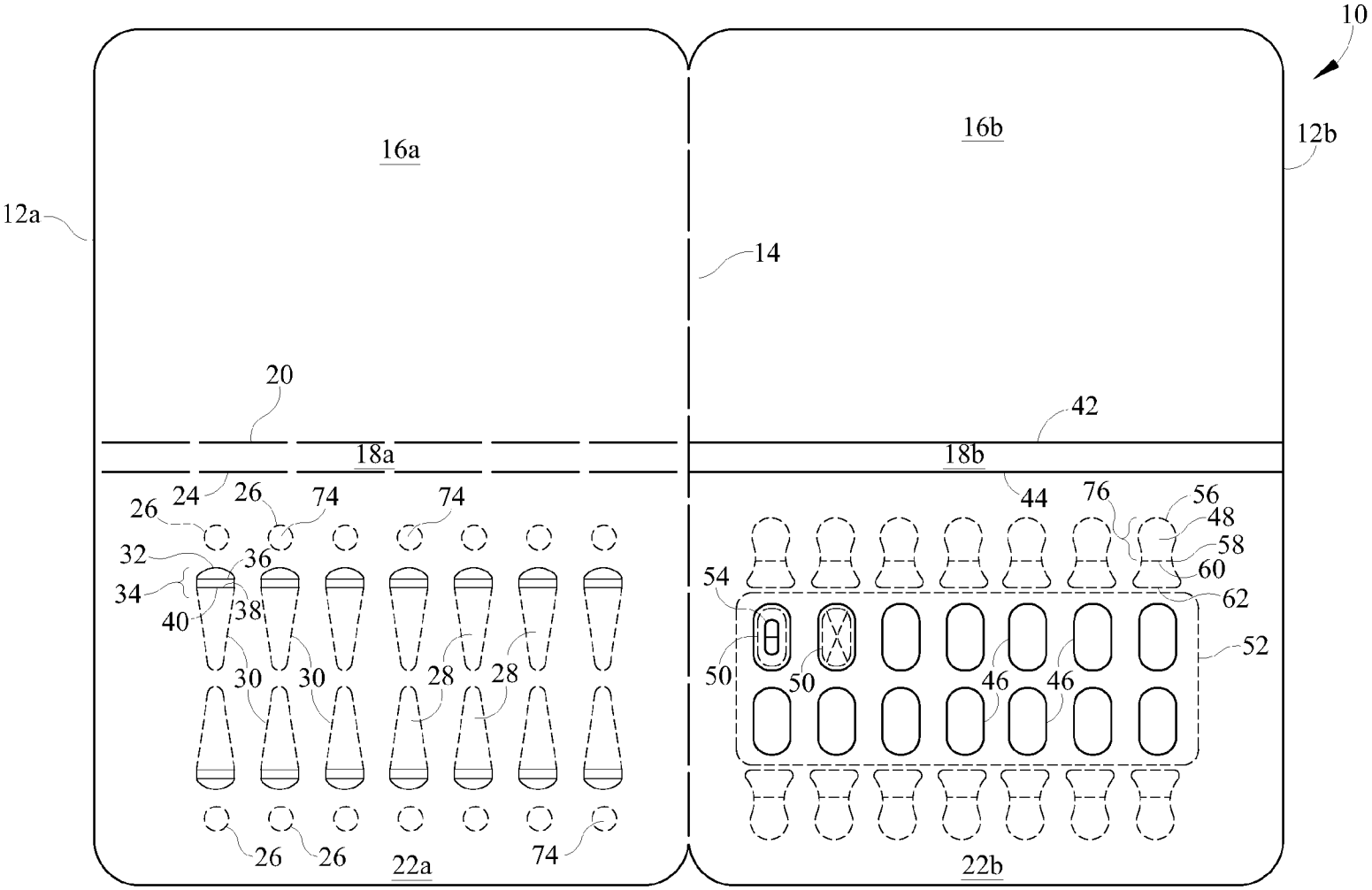
FIG. 1 is a plan view of an exemplary packaging blank, according to an embodiment of the present invention.

Referring now to the drawings, wherein like elements are represented by like numerals, and wherein like articles and respective elements are, at times, represented by primed numerals, FIG. 1 is a plan view of an exemplary packaging blank 10 made according to the present invention.

The packaging blank 10 includes a back panel 12*a* and a face panel 12*b*. The face panel 12*b* and the back panel 12*a* are hingedly connected along a foldable score line 14. Although in this exemplary embodiment, the panels 12*a*, 12*b* are illustrated as integrally formed as one piece, it should be understood that the respective panels 12*a*, 12*b* can be formed as two separate and distinct pieces. The packaging blank 10 can be constructed from any suitable substrate material. Suitable substrate materials include, but not limited to, plastics, conventional paperboard, including solid bleached sulfate (SBS) paperboard of suitable weight, size and shape, and combinations thereof. Commercial examples of suitable substrate include EASY SEAL® and EASY SEAL PLUS® self-sealing boards, both of which are currently available from Mead-Westvaco Corporation. Additionally, it is contemplated that embodiments of the present invention may be used in conjunction with NATRALOCK® packaging systems. Additionally, a tear-resistant layer may or may not be adhered to the packaging blank 10. Tear-resistant layers, if included, are often laminated to the blank before cutting. Furthermore, it is possible, and in fact contemplated, that an abhesive layer or material may be added to the packaging blank 10 prior to assembling the packaging blank 10 into a package, as will be explained below. The packaging blank 10 may also be an unbleached board, depending on the desired appearance of the final package.

The back panel 12*a* further includes a top portion 16*a*. The top portion 16*a* is hingedly connected to a spacer portion 18*a* along a foldable score line 20. The spacer portion 18*a* is hingedly connected to a bottom portion 22*a* along a foldable score line 24. The bottom portion 22*a* further includes severance lines 26 and tab strips 28. The severance lines 26 can be shaped and dimensioned to allow removal of material by interfacing with and/or receiving a tool in a method that will be described in more detail below. A tab strip 28 can be defined by a severance line 30 and a cut line 32, and can further include a pull tab portion 34. A pull tab portion 34 can include foldable score lines 36, 38 and a cut line 40. As will be explained in greater detail below, the tab strips 28 can have any desired shape and dimensions. For example, the bottom panel 22*a* can be configured to include gates (not shown) that can be left after a tab strip 28 is removed.

The face panel 12*b* further includes a top portion 16*b*. The top portion 16*a* is hingedly connect to a spacer portion 18*b* along a score line 42. The spacer portion 18*b* is hingedly connected to a bottom portion 22*b* along a score line 44.

Bottom portion 22*b* further includes blister apertures 46 and tool portions 48. The blister apertures 46 are shaped and dimensioned to receive the blisters 50 of a blister pack 52. As illustrated, one or more blisters 50 can contain a product 54, illustrated in FIG. 1 as a capsule of medication. In the illustrated embodiment, the tool portions 48 are formed by a severance lines 56 in the bottom portion 22*b*. A tool portion can further include a cut line 58 and foldable score line 60. A least a portion of a tool portion 48 can be hingedly connected to the bottom panel 22*b* along a foldable score line 62.

Figure 2:
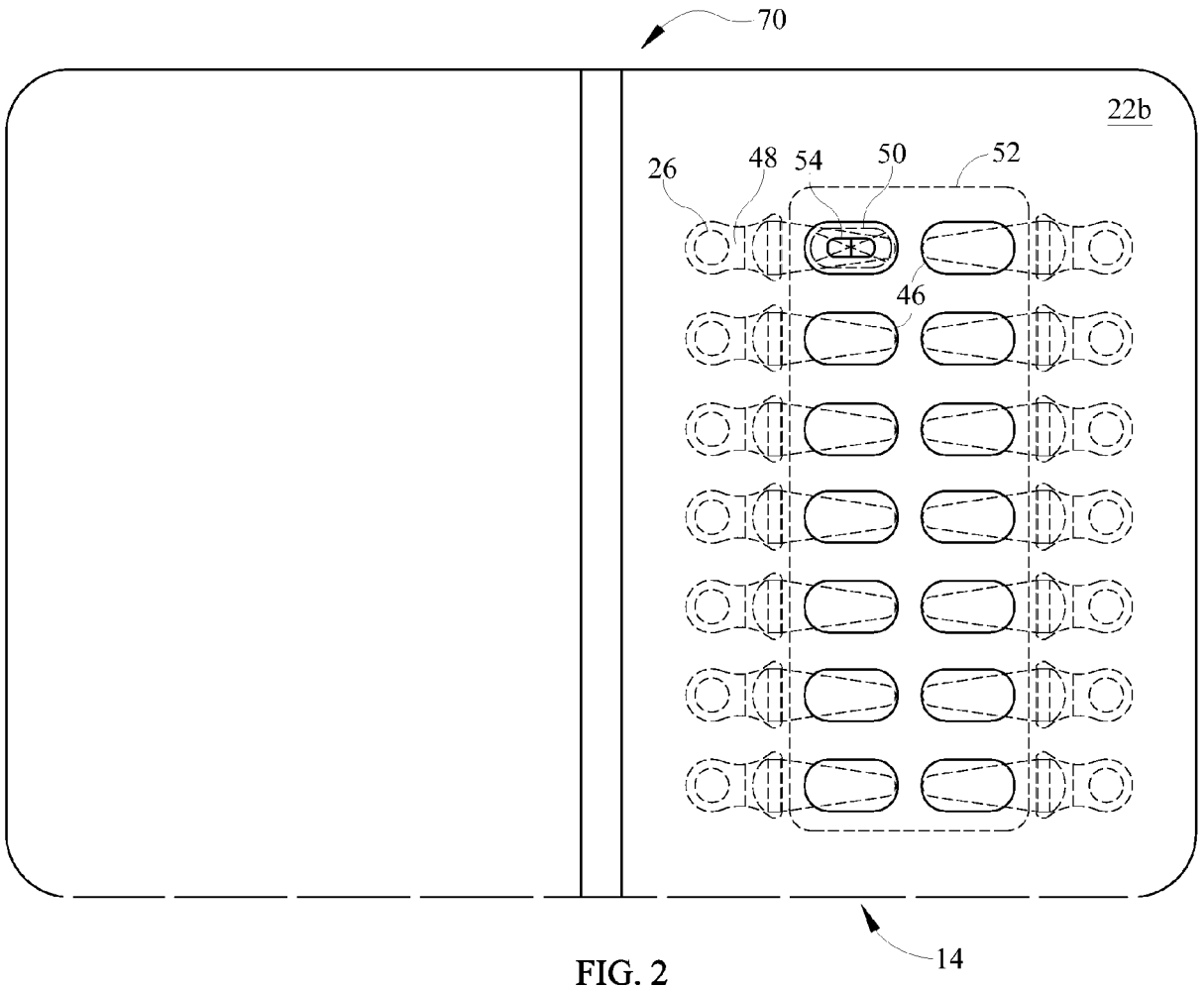
FIG. 2 is a plan view of an exemplary package, made from the packaging blank of FIG. 1.
Figure 3:
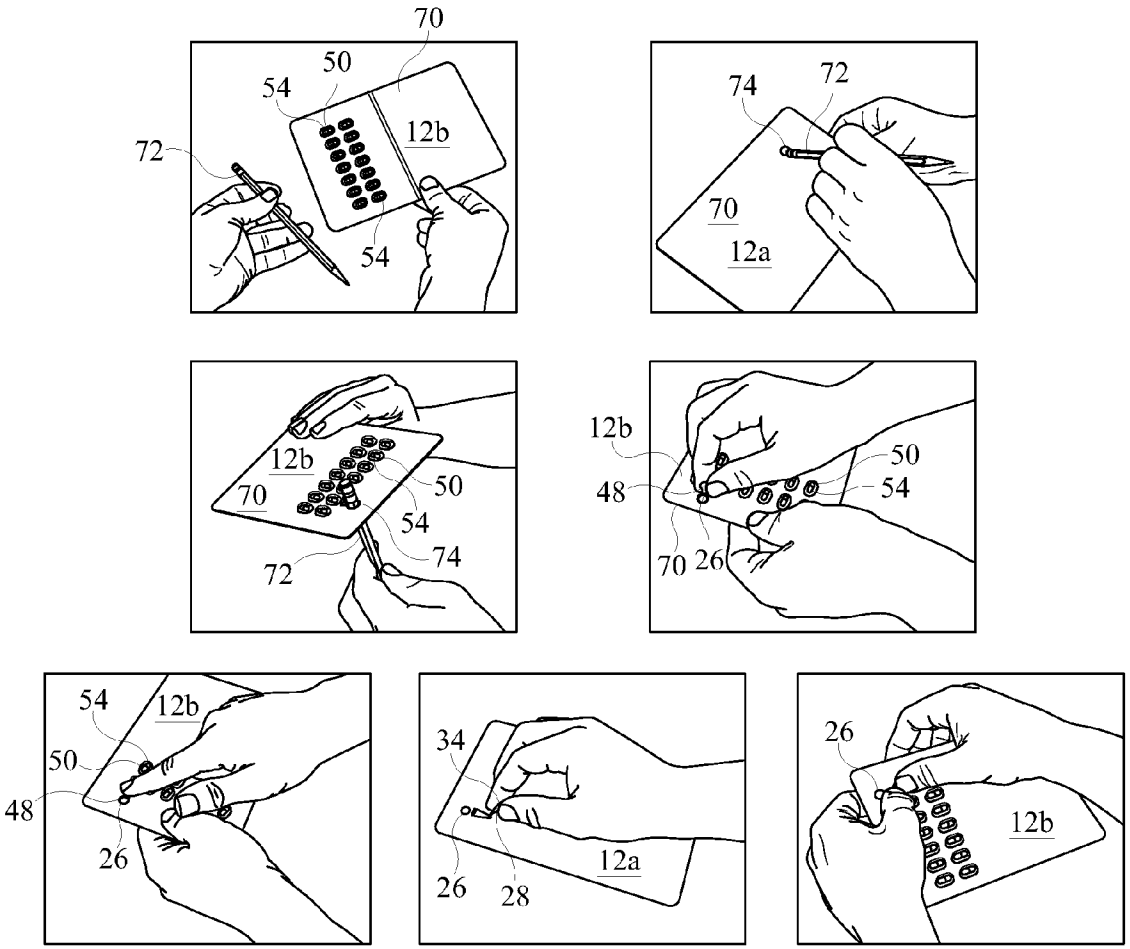
FIG. 3 illustrates a method for accessing products packaged in the exemplary package of FIG. 2.

With additional reference now to FIGS. 2-3, a package 70, made from packaging blank 10, is shown. A package 70 is formed by inserting the blisters 50 of a blister pack 52 into respective blister apertures 46, such that the blisters 50 protrude from the face panel 12*b*. After the blister pack 52 is in position, the blank 10 can be folded into a face contacting arrangement, and secured. To fold the blank 10, the facing surfaces of the bottom panel 12*a* and the face panel 12*b* are brought toward each other by folding along foldable score line 14. In completing the folding step, the tab strips 28 are aligned with respective blister apertures 46, and thereby with blisters 50 of blister pack 52. Likewise, the severance lines 26 cooperatively align with respective tool portions 48. The face panel 12*b* and the bottom panel 12*a* can be secured to one another, and the blister pack 52 can thereby be held in place, using any desired means or methods.

In practice, to access an item 54 from a package 70, a tool 72, illustrated as a pencil, is pressed onto a tool access portion 74, which is defined by score line 26 in bottom panel 12*a*. When pressure is applied to a tool access portion 74, the circular piece of material defined by score line 26 is severed from the bottom panel 12*a* and is then pushed into, and applies force to, an interface portion 76 of a tool portion 48. When force is applied to the interface portion 76, at least a portion of the tool portion 48 is severed from the face panel 12*b* along severance line 56. Since a portion of a tool portion 48 is now severed, a user can grasp the severed portion of the tool portion 48 and lift it away from the face panel 12*b*, thereby separating most of the tool portion from the face panel 12*b*.

As shown in FIGS. 1-3, part of a tool portion 48 is hingedly connected to face panel 12*b* by a foldable score line 62. As such, tool portion 48 remains attached to face panel 12*b* after severance line 56 has been severed.

After the tool portion 48 is accessible, the tool portion is folded along foldable score line 60, by folding the interface portion 76 toward the beginning of a tab strip 28 on bottom panel 12*a*, which is visible in the area revealed by lifting a tool portion 48 away from face panel 12*b*. The interface portion 76 of tool portion 48 can now be pushed into a pull tab portion 34 of a tab strip 28. When force is applied to the pull tab portion 34, the pull tab portion 34 separates from the bottom panel 12*a* along severance line 30. The pull tab portion 34 can be made more accessible to a user's grasp by the inclusion of foldable score lines 36, 38, and cut line 40. This can encourage the pull tab portion 34 to bend up and away from the applied force, thereby encouraging pull tab portion 34 to lift away from the package 70. At this point, a user can grasp the pull tab portion 34 and pull the pull tab portion 34 away from face panel 12*b*, thereby severing tab strip 28 from bottom panel 12*a*. As mentioned above, the shape of severance line 30 can be altered as desired to create gates (not shown) to add more child-resistance to the package 70. Alternative tab strip 28 designs will be discussed in further detail below.

Figure 4:
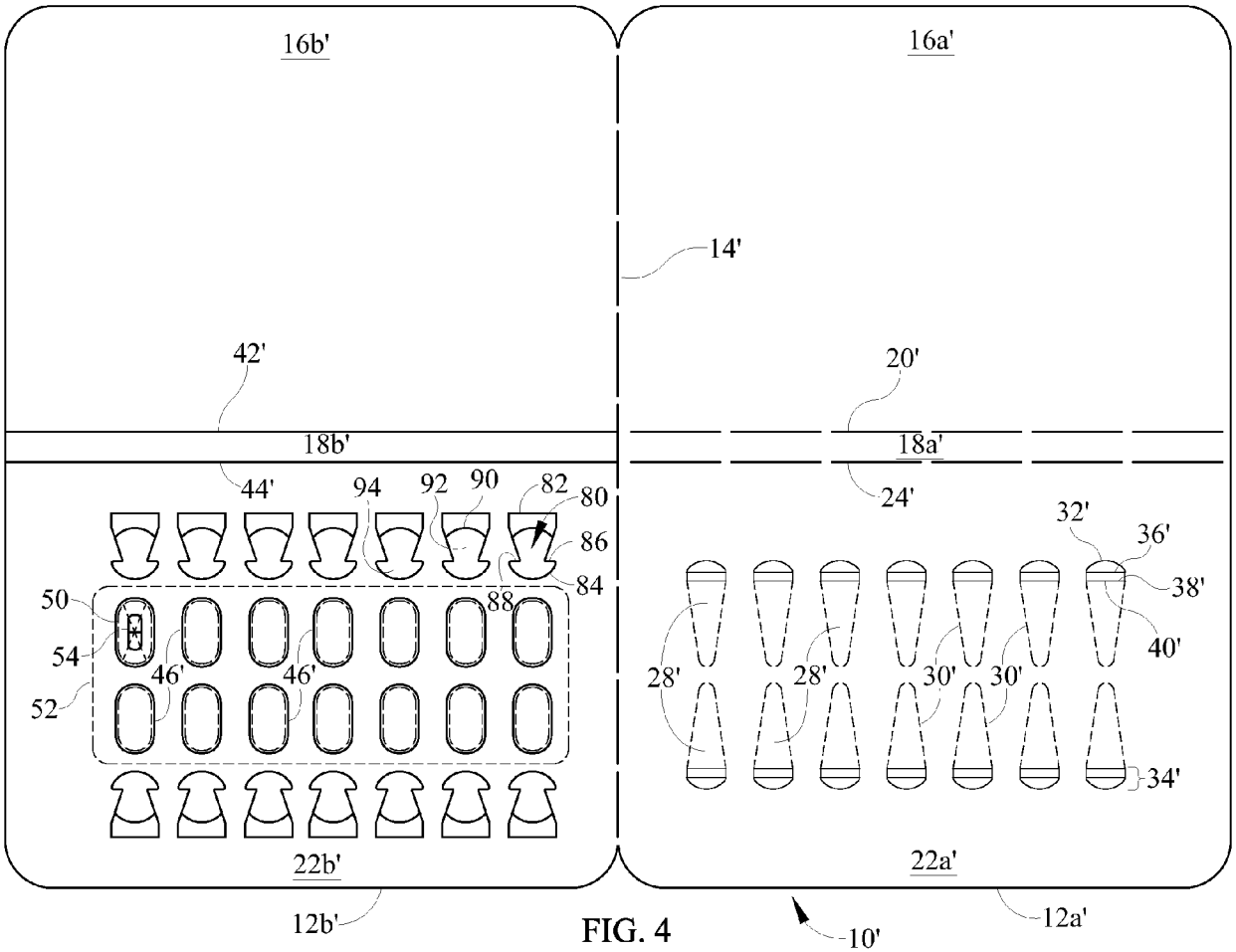
FIG. 4 is a plan view of an exemplary packaging blank, according to an embodiment of the present invention.

Referring now to FIG. 4, an alternative design for a packaging blank 10' is shown. In FIG. 4, primed numerals denote features that can have similar structure, design, and/or purpose as the features denoted by unprimed numerals in FIGS. 1-3.

The packaging blank 10' includes a bottom panel 12*a*', and a face panel 12*b*'. The panels 12*a*', 12*b*' are hingedly connected along foldable score line 14'.

Although in this exemplary embodiment, the panels 12*a*', 12*b*' are illustrated as integrally formed as one piece, it should be understood that the respective panels 12*a*', 12*b*' can be formed as two separate and distinct pieces.

The bottom panel 12*a*' can further include a top portion 16*a*', which is hingedly connected to a spacer portion 18*a*', along a foldable score line 20'. The spacer portion 18*a*' is hingedly connected to a bottom portion 22*a*' along a foldable score line 24'.

The bottom portion 22*a*' further includes tab strips 28'. A tab strip 28' can be defined by a severance line 30' and a cut line 32' and can include a pull tab portion 34'. A pull tab portion 34' can includes foldable score lines 36', 38' and a cut line 40'. As will be explained in greater detail below, the tab strips 28' can have any desired shape and dimensions. For example, the bottom panel 22*a*' can be configured to include gates (not shown) that can be left after a tab strip 28' is removed.

The face panel 12*b*' can include a top portion 16*b*'. The top portion 16*b*' is hingedly connected to a spacer portion 18*b*' along a foldable score line 42'. The spacer portion 18*b*' is hingedly connected to a bottom portion 22*b*' along a foldable score line 44'. Bottom portion 22*b*' further includes blister apertures 46' and tool portions 80. The blister apertures 46' are shaped and dimensioned to receive the blisters 50 of a blister pack 52. As illustrated, one or more blisters 50 can contain a product 54, illustrated in FIG. 4 as a capsule of medication. In the illustrated embodiment, the tool portions 80 are formed by cut lines 82, 84, and fold lines 86, 88 in the bottom portion 22*b*'. The fold lines 86, 88 can hingedly connect the tool portions 80 to the bottom panel 22*b*' and create a fulcrum or pivot point about which the tool portions 80 can rotate. An additional cut line can be made in a tool portion 80, and the material between cut lines 82 and 90 can be removed to create a graspable edge 90 of a tool portion 80.

It should be understood that while the tool portions 80 of the illustrated embodiment are formed from two cut lines 82, 84, some or all of cut lines 82, 84 can be substituted for a severance line; thereby increasing the child-resistant qualities of a package made from the packaging blank 10'.

Figure 5:
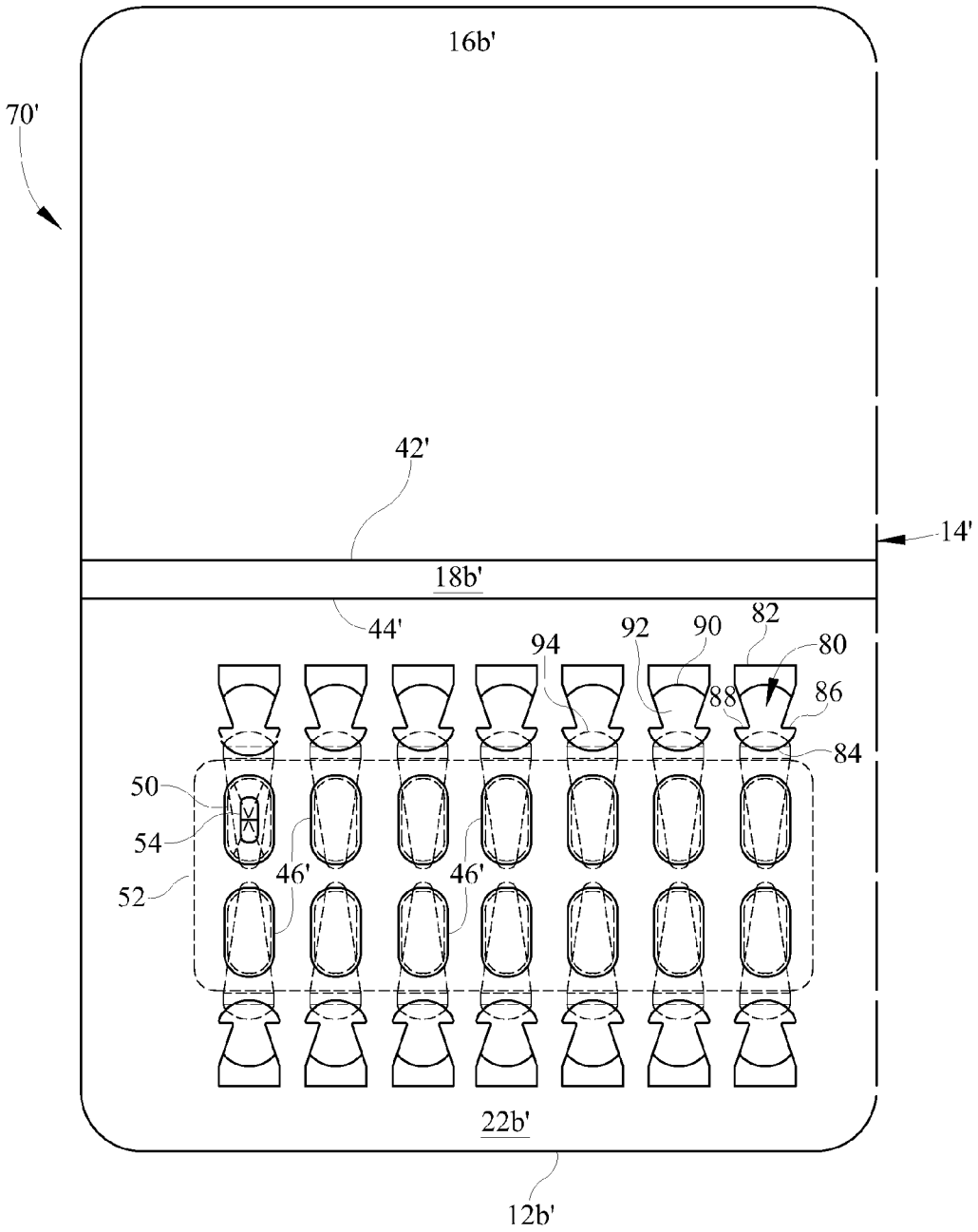
FIG. 5 is a plan view of an exemplary package, made from the packaging blank of FIG. 4.
Figure 6:
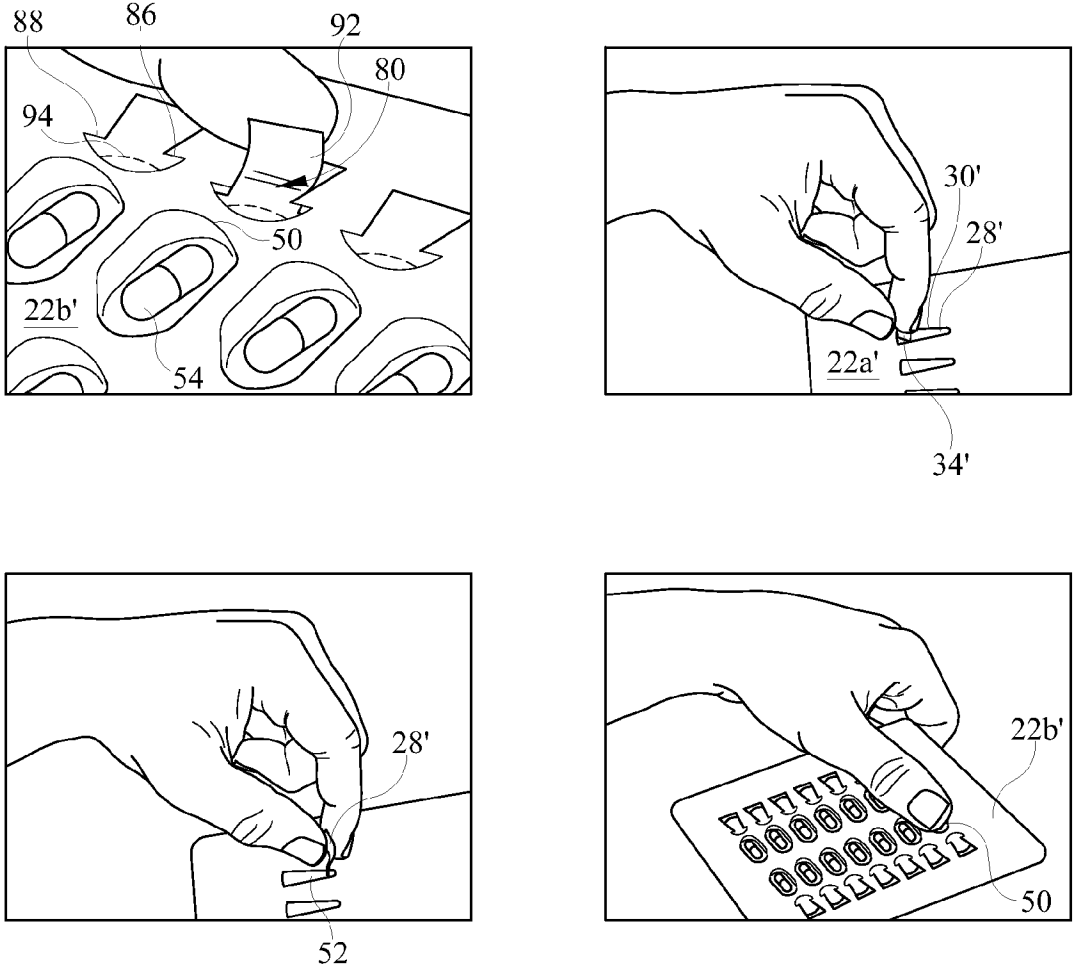
FIG. 6 illustrates a method for accessing products packaged in the exemplary package of FIG. 5.

With additional reference now to FIGS. 5-6, a package 70', made from packaging blank 10', is shown. A package 70' is formed by inserting the blisters 50 of a blister pack 52 into respective blister apertures 46', such that the blisters 50 protrude from the face panel 12*b*'. After the blister pack 52 is in position, the blank 10' can be folded into a face contacting arrangement, and secured. To fold the blank 10', the facing surfaces of the bottom panel 12*a*' and the face panel 12*b*' are brought toward each other by folding along foldable score line 14'. In completing the folding step, the tab strips 28' are aligned with respective blister apertures 46', and thereby with blisters 50 of blister pack 52. The face panel 12*b*' and the bottom panel 12*a*' can be secured to one another, and the blister pack 52 can thereby be held in place, using any desired means or methods.

In practice, to access an item 54 from a package 70', upward pressure, i.e., a pressure that pulls away from the face panel 12*b*' and the bottom panel 12*a*', is applied to a pull-away portion 92 of a tool portion 80. When such a force is applied to the pull-away portion 92, the tool portion 80 rotates along fold lines 86, 88 and an actuator portion 94 of the tool portion 80 thereby rotates downward, i.e., into a pull tab portion 34' of a tab strip 28'. This force, applied by an actuator portion 94 to a pull tab portion 34', causes the pull tab portion 34' to at least partially separate from the bottom panel 12*a*' along cut line 32' and severance line 30'. The pull tab portion 34' can be made more accessible to a user's grasp by the inclusion of foldable score lines 36', 38', and cut line 40'. This causes the pull tab portion 34' to bend up and away from the applied force, thereby encouraging pull tab portion 34' to lift away from the package 70'. At this point, a user can grasp the pull tab portion 34' and pull away from face panel 12*b*', thereby severing at least a portion of tab strip 28' from bottom panel 12*a*'.

As mentioned above, the shape of severance line 30' can be altered as desired to create gates (not shown) to add more child-resistance to the package 70'. Alternative tab strip 28' designs will be discussed in further detail below.

Figure 7:
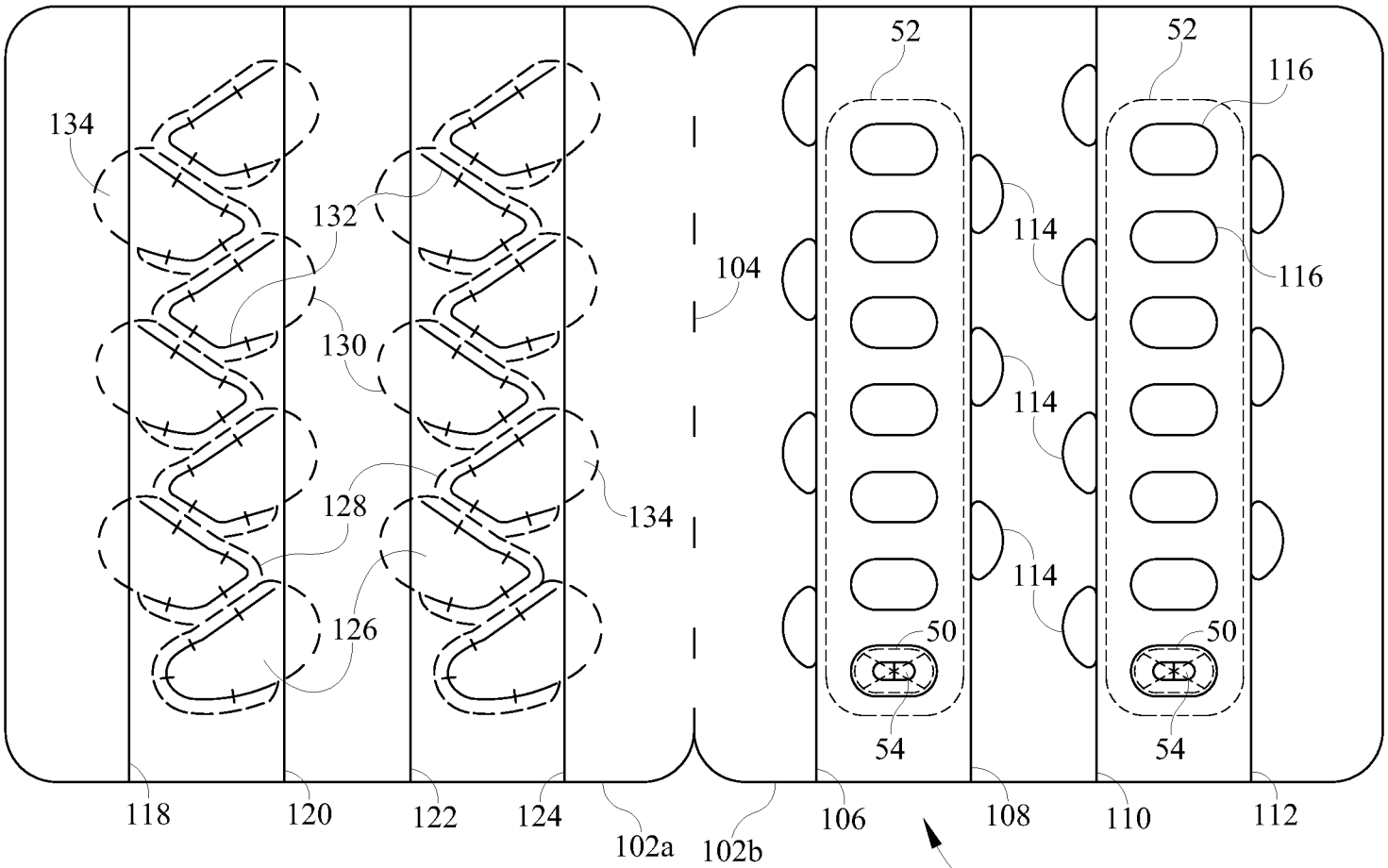
FIG. 7 is a plan view of an exemplary packaging blank, according to an embodiment of the present invention.

Referring now to FIG. 7, an alternative design for a packaging blank 100 is shown. The packaging blank 100 includes a bottom panel 102*a*, and a face panel 102*b*. The panels 102*a*, 102*b* are hingedly connected along foldable score line 104. Although in this exemplary embodiment, the panels 102*a*, 102*b* are illustrated as integrally formed as one piece, it should be understood that the respective panels 102*a*, 102*b* can be formed as two separate and distinct pieces.

The face panel 102*b* can include foldable score lines 106, 108, 110, and 112. The face panel 102*b* can also include tool access apertures 114. The tool access apertures 114 can be shaped and dimensioned to receive a tool, a user's hand, or another suitable device therethrough. Additionally, the face panel 102*b* can include blister apertures 116. The blister apertures 116 are shaped and dimensioned to receive the blisters 50 of a blister pack 52. As illustrated, one or more blisters 50 can contain a product 54, illustrated in FIG. 7 as a capsule of medication.

The bottom panel 102*a* can include foldable score lines 118, 120, 122, and 124. The bottom panel 102*a* further includes tab strips 126. The tab strips 126 can be defined by severance lines 128 and 130, and cut lines 132. The tab strips 126 can include a pull tab portion 134 that is defined by severance lines 126 and foldable score lines 118, 120, 122, and 124. In the illustrated embodiment, the severance lines 126 that define the pull tab portions 134 pass through both sides of the bottom panel 102*a*. However, severance lines 128 and 130, as well as cut lines 132, only pass through a portion of the bottom panel 102*a*.

As will be explained in greater detail below, the tab strips 126 can have any desired shape and dimensions. For example, the bottom panel 102*a* can be configured to include gates (not shown) that can be left after a tab strip 126 is removed.

Figure 8:
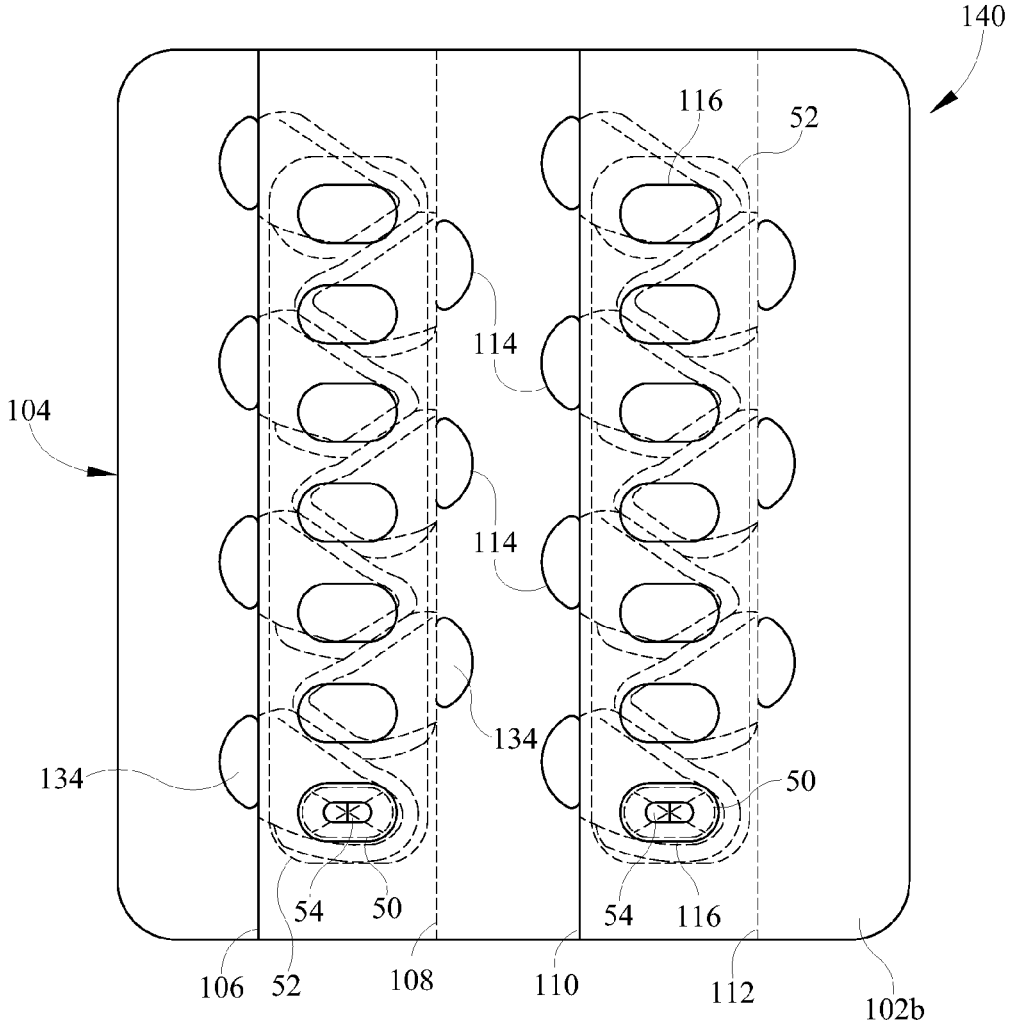
FIG. 8 is a plan view of an exemplary package, made from the packaging blank of FIG. 7.
Figure 9:
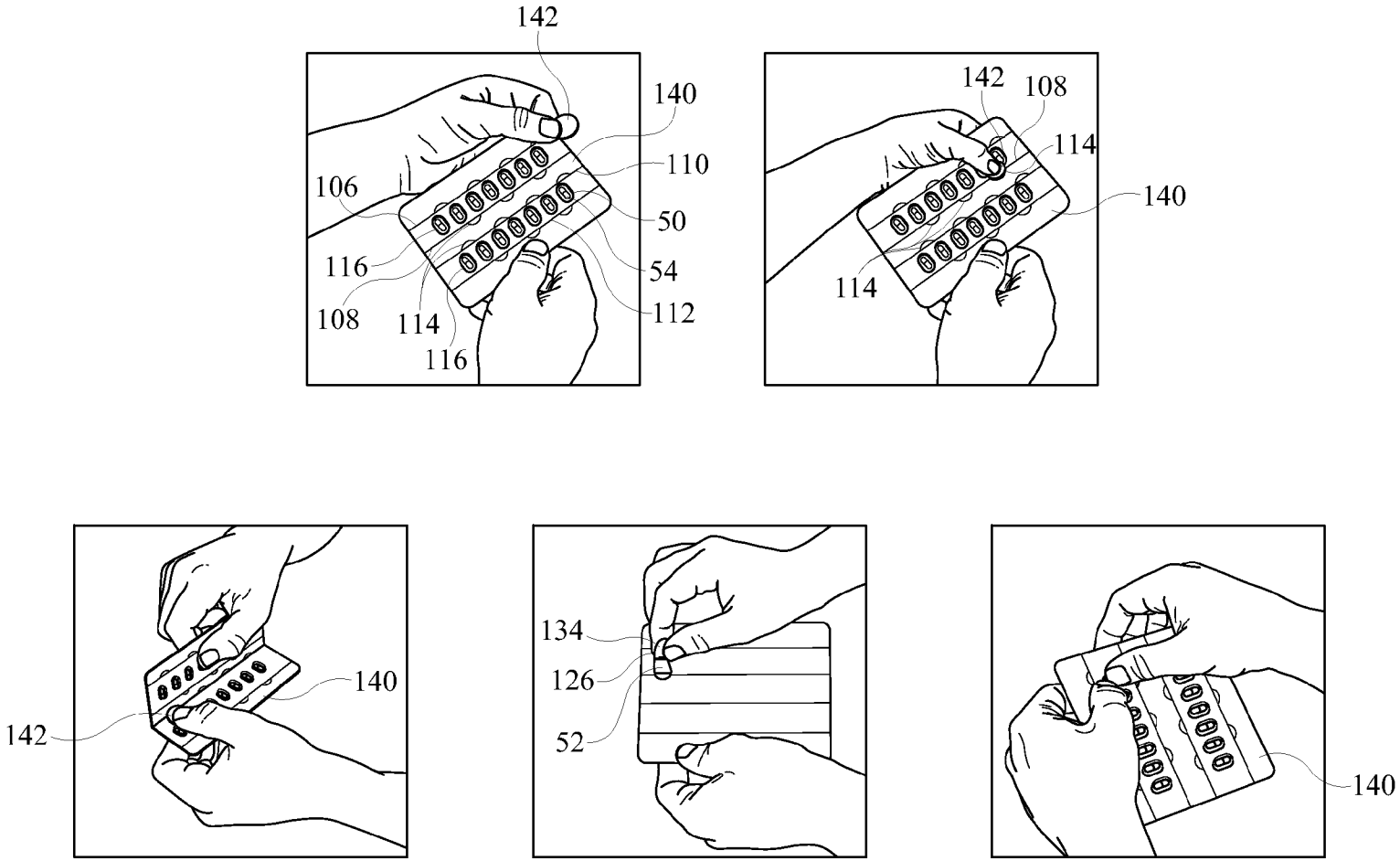
FIG. 9 illustrates a method for accessing products packaged in the exemplary package of FIG. 8.

With additional reference now to FIGS. 8-9, a package 140, made from packaging blank 100, is shown. A package 140 is formed by inserting the blisters 50 of one or more blister packs 52 into respective blister apertures 116, such that the blisters 50 protrude from the face panel 102*b*. In the illustrated embodiment, the package 140 contains two single-row blister packs 52. It should be understood that the package 140 can include less than two blister pack 52 or more than two blister packs, and although the illustrated blister packs 52 appear identical, there can be any number of blister packs 52, each with a different shape, dimensions, and/or contents. After the blister packs 52 are in position, the blank 100 can be folded into a face contacting arrangement, and secured. To fold the blank 100, the facing surfaces of the bottom panel 102*a* and the face panel 102*b*, are brought toward each other by folding along foldable score line 104. In completing the folding step, the tab strips 126 are aligned with respective blister apertures 116, and thereby with blisters 50 of blister pack 52. The face panel 102*b* and the bottom panel 102*a* can be secured to one another, and the blister pack(s) 52 can thereby be held in place, using any desired means or methods.

In practice, to access an item 54 from a package 140, a user places a tool 142 into a tool access aperture 114. In the illustrated embodiment, the tool access apertures 114 are shaped and dimensioned to accept at least a portion of a standard current-issue U.S. penny.

In the illustrated embodiment, the tool 142, in this case a penny is laid down with a leading edge of the penny placed such that an edge of the penny aligns with an edge of a tool access aperture 114. After placing the tool 142 in place, the entire package 140 is bent along one of the four available foldable score lines 106, 108, 110, and 112, namely, the fold line adjacent the tool access aperture 114 with which the tool 142 is aligned. It should be noted that after assembly of the package 140 from packaging blank 100, foldable score lines 106, 108, 110, and 112 are aligned with, and cooperate with, foldable score lines 118, 120, 122, and 124. As the package 140 is being bent, the tool 142 can be held in place. The package 140 can be bent until the force of the tool pushing on a pull tab portion 134 of a tab strip 126 causes the pull tab portion 134 to become severed from the surrounding material of the bottom panel 102*a*. Once the pull tab portion 134 is severed from the surrounding material of the bottom panel 102*a*, the user can grasp the pull tab portion 134 and pull the tab strip 126 away from the blister pack 52 until the tab strip 126 is either severed from the package 140, or until there is adequate access to allow an item 54 to pass out of the package 140.

Figure 10:
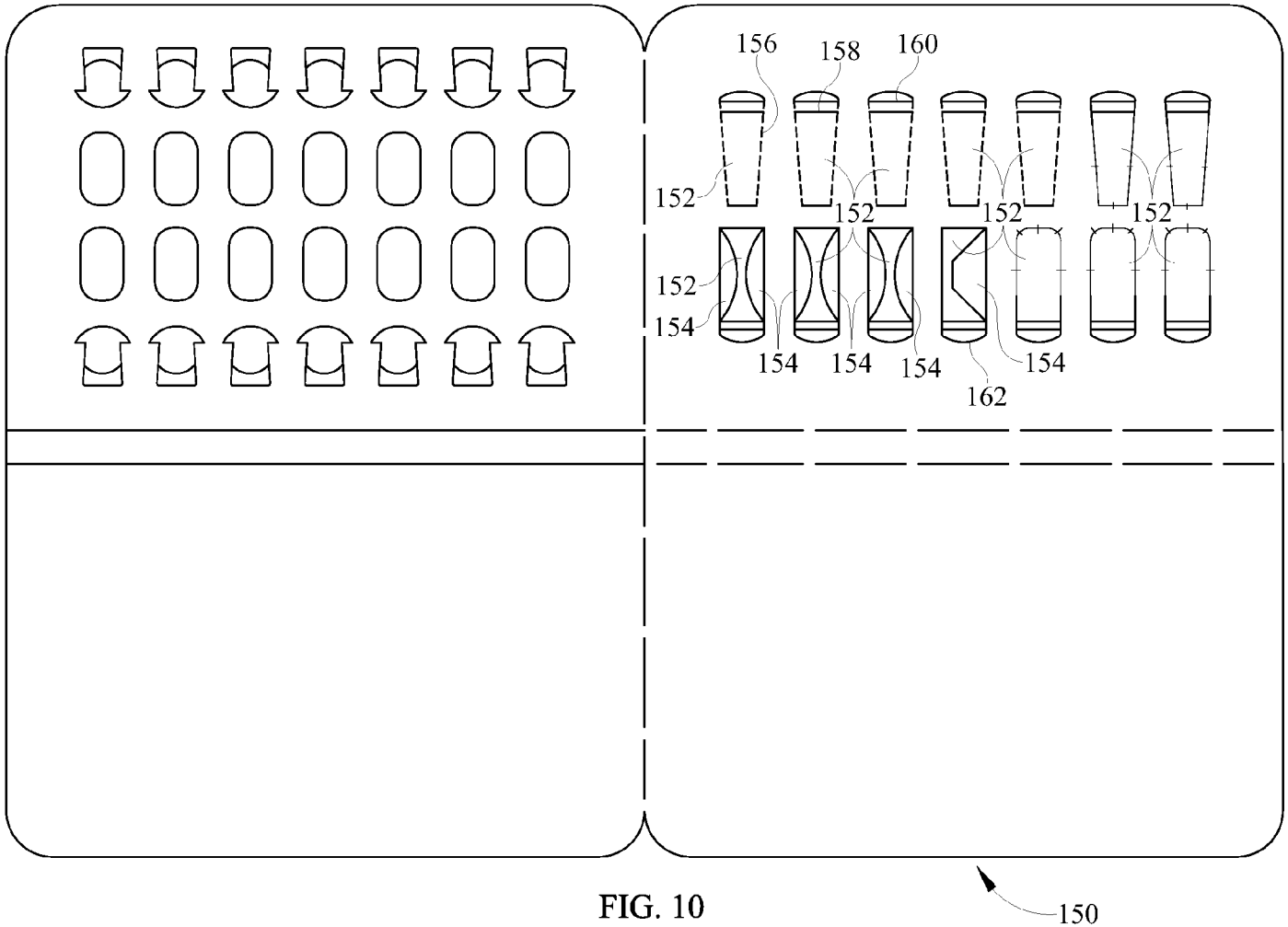
FIG. 10-11 illustrate various shapes for tab strips of packaging made in accordance with the present invention.

Turning now to FIGS. 10-15, alternative designs for various features of packaging are illustrated. FIG. 10 illustrates a package blank 150. Although the illustrated package blank 150 appears somewhat similar to the package blank 10' of FIG. 4, the concepts described herein can be employed with any of the described embodiments, or any embodiment of this invention made in accordance with the concepts of the foregoing description.

As illustrated, a package blank 150 includes a plurality of tab strips 152. Although the tab strips 152 are illustrated as having varied designs, shapes, and dimensions, some or all of the tab strips 152 can be substantially identical. Some of the illustrated tab strips have an irregular shape to provide gates 154 upon removal of the tab strips 152. The tab strips 152 can be formed by severance lines 156, cut lines 158, 160, fold lines 162, and combinations thereof. While many of the lines of FIG. 10 are represented as either cut lines, severance lines, or fold lines, it should be understood that the tab strips 152 can be formed from any desired combination of line types, as desired or required for any particular purpose or application. For example, the inclusion of gates 154 and the varying of line types employed to form the tab strips 152 can change the relative level of child resistance of a package 150.

Figure 11:
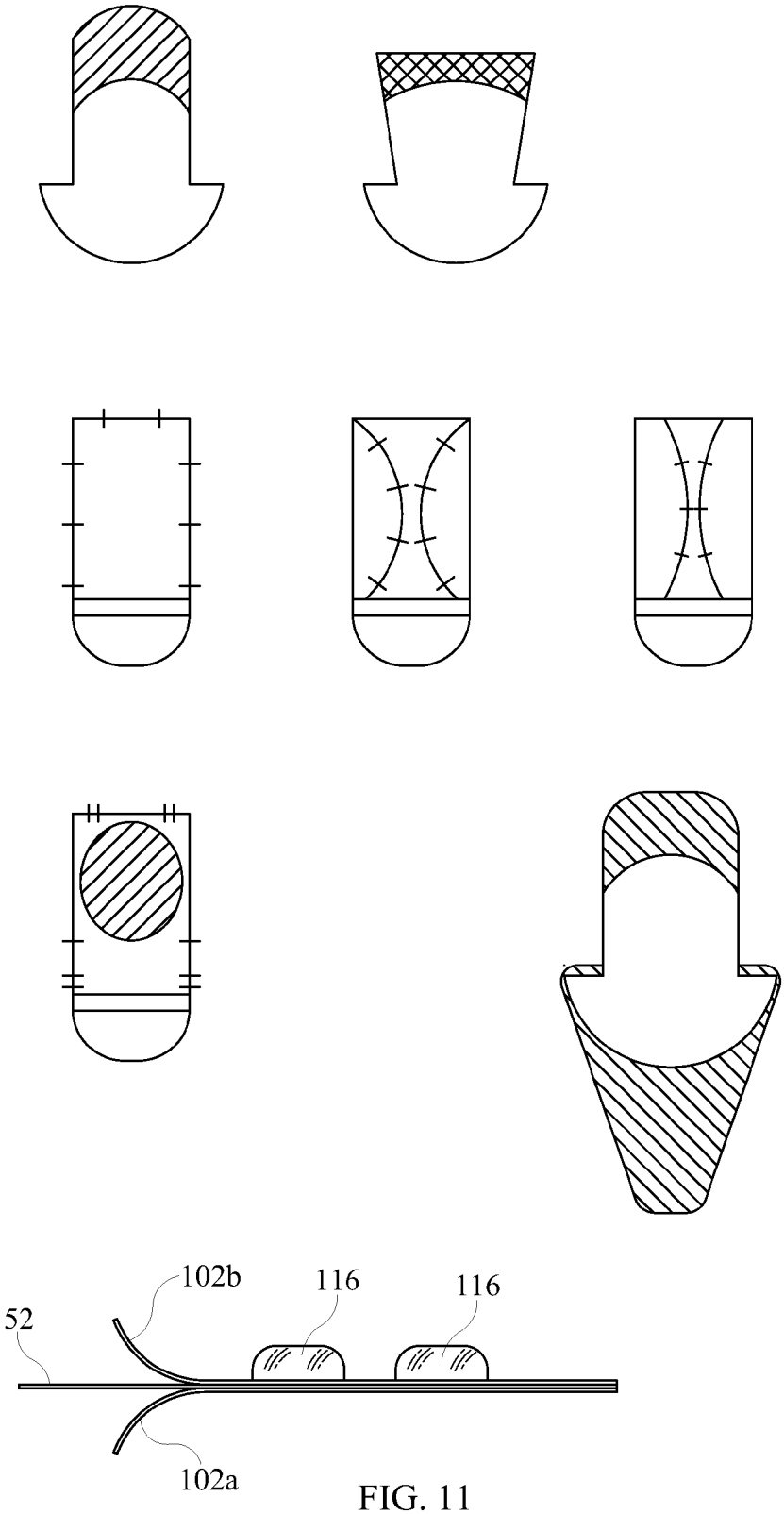
Figure 12:
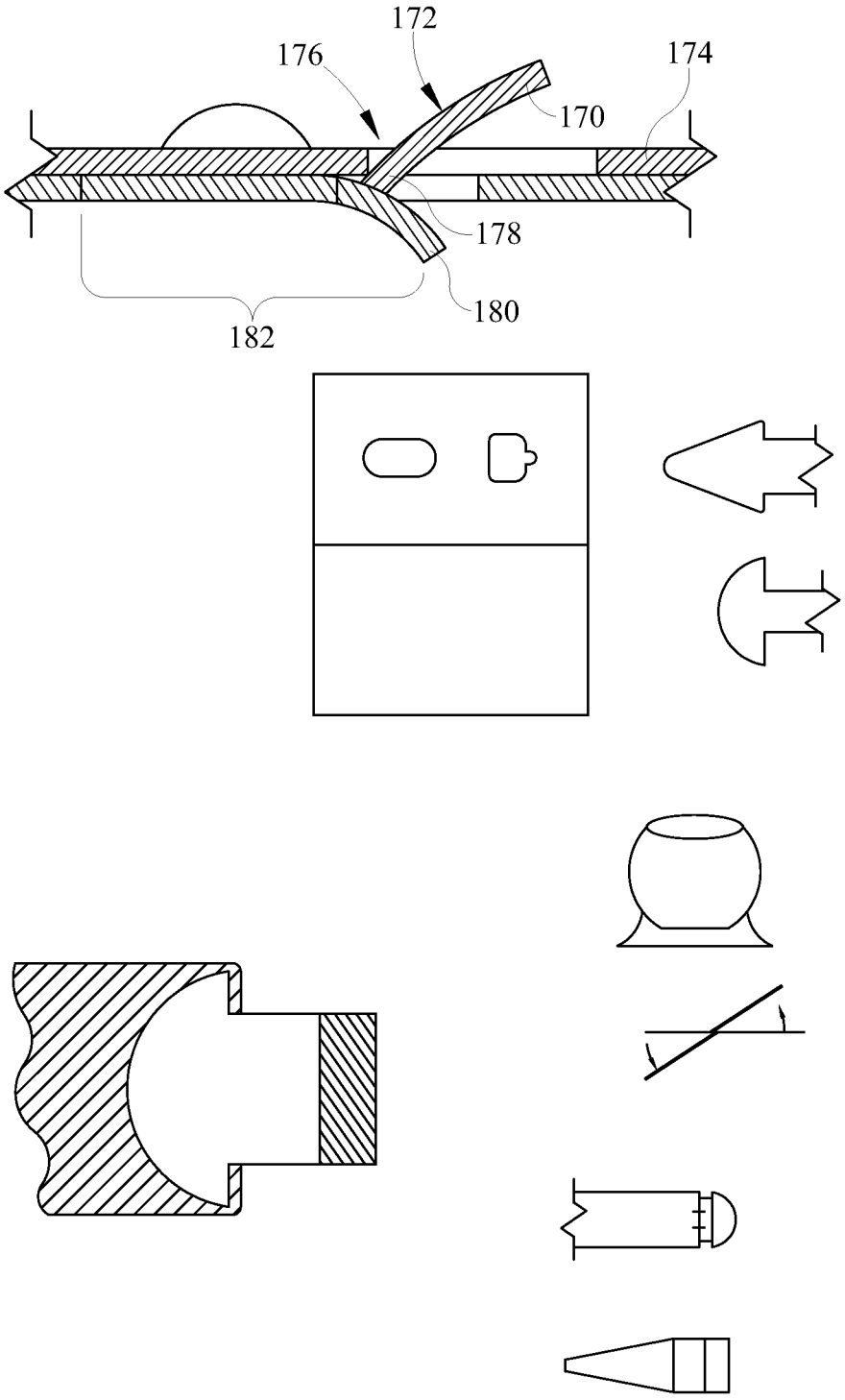
FIG. 12-14 illustrate the pivoting action of tool portions of packaging made in accordance with the present invention.
Figure 13:
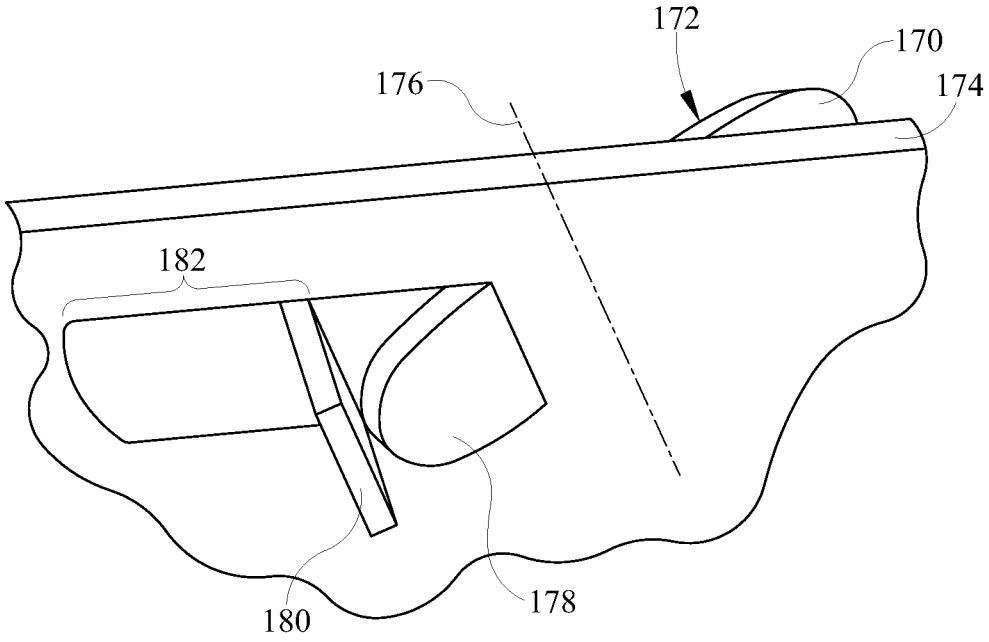
Figure 14:
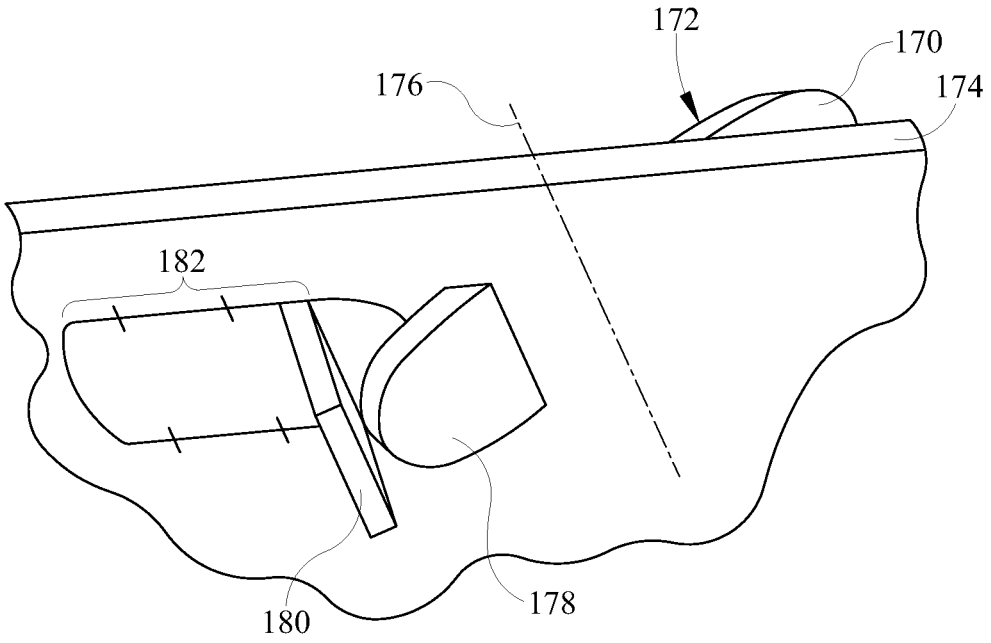

FIG. 11 illustrates variations in design of tab strips, tool portions, and how to vary line type usage to achieve various objectives. FIGS. 12-14 illustrate in greater detail the pivot action of the tool portions for embodiments of packing in which a tool portion is included, including the embodiments illustrated in FIGS. 1-6. As shown at the top of FIG. 12, as the grasping end 170 of a tool portion 172 is lifted away from the packaging 174, the tool portion 172 rotates about a pivot region 176. As explained above, a pivot region 176 can be formed by severing most of the tool portion, but leaving at least one edge hingedly connected to the surrounding material along one or more fold lines. As the tool portion 172 rotates about a pivot region 176, the actuating portion 178 of the tool portion 172 rotates downward, toward the packaging, and applies a force to a pull tab portion 180 of a tab strip 182. This force causes at least a portion of the pull tab portion 180 of the tab strip 182 to be pushed away from the packaging 174. A user can then grasp the pull tab portion 180 of a tab strip 182 and sever, at least partially, the tab strip 182 from the surrounding material of the packaging 174. FIGS. 13 and 14 illustrate this pivot action from another angle.

Packaging 174 may be sealed together using an fully or partially-applied adhesive and/or selective heat sealing. Tool portion 172 may have an abhesive layer (release agent) between the bottom of tool portion 172 and the top of the bottom layer of packaging 174. In the alternative, a heat seal adhesive may be used to seal packaging 174. In such a package, the heat seal adhesive may be over the entire blank sides including packaging 174, tool portion 172, pivot region 176, release pull tab 180 and/or tab strip 182 and heat applied to packaging 174 such that tool portion 172 pivot region 176, release pull tab 180 and/or tab strip 182 are not adhered to one another. This allows the user to separate tool portion 172 from the lower layer of packaging 174 and create the pivot movement at pivot region 176 that releases pull tab 180 of tab strip 182 and sever, at least partially, tab strip 182 from surrounding packaging 174.

Figure 15:
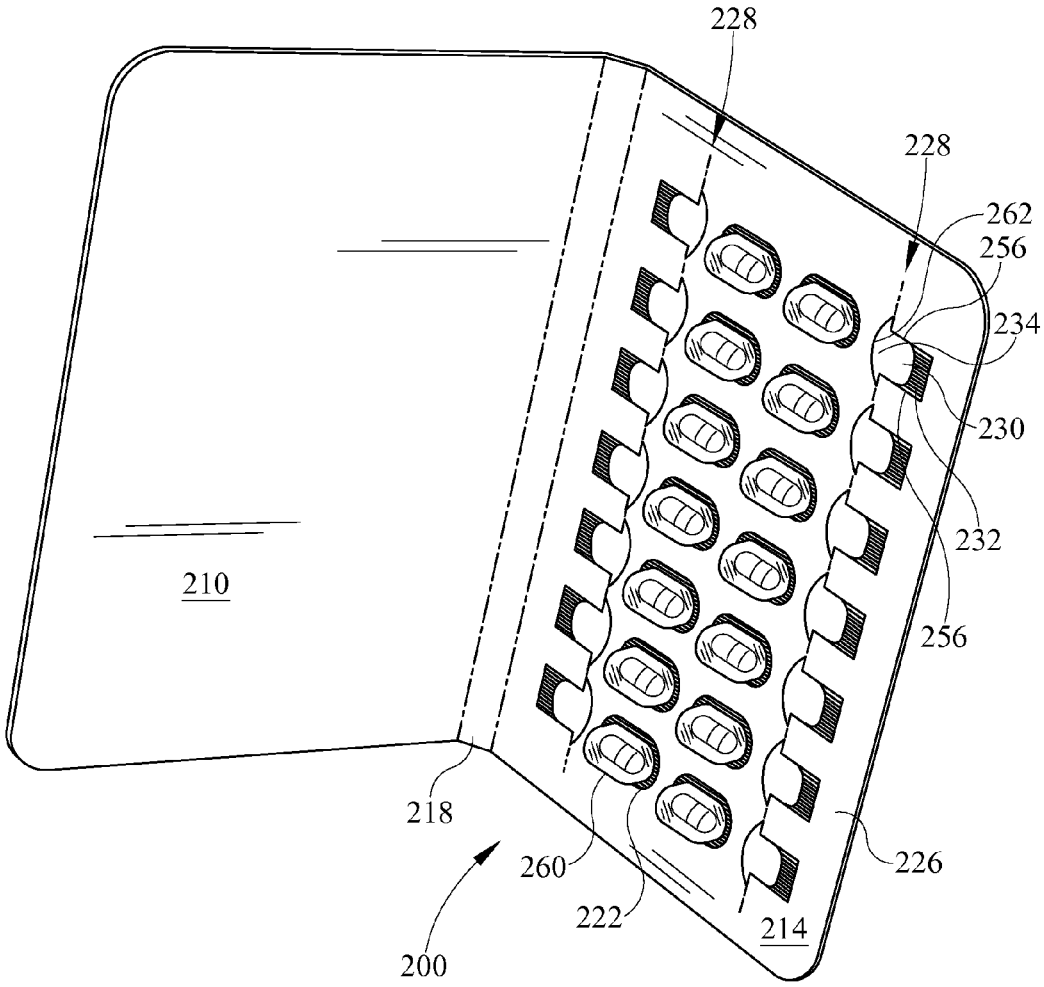
FIG. 15 illustrates an exemplary package, according to an embodiment of the invention.
Figure 16:
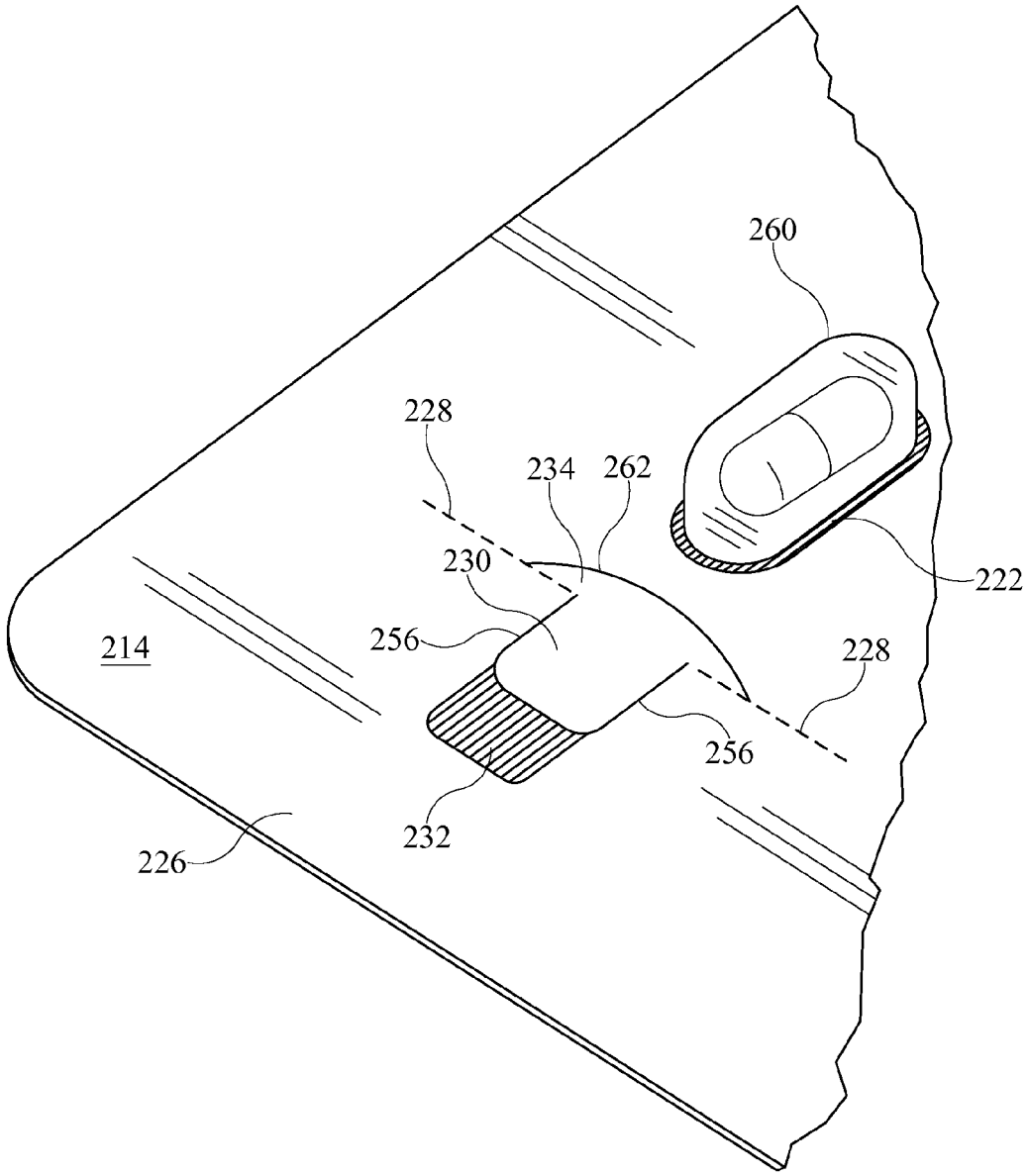
FIG. 16-19 illustrate a close-up of the opening features.
Figure 17:
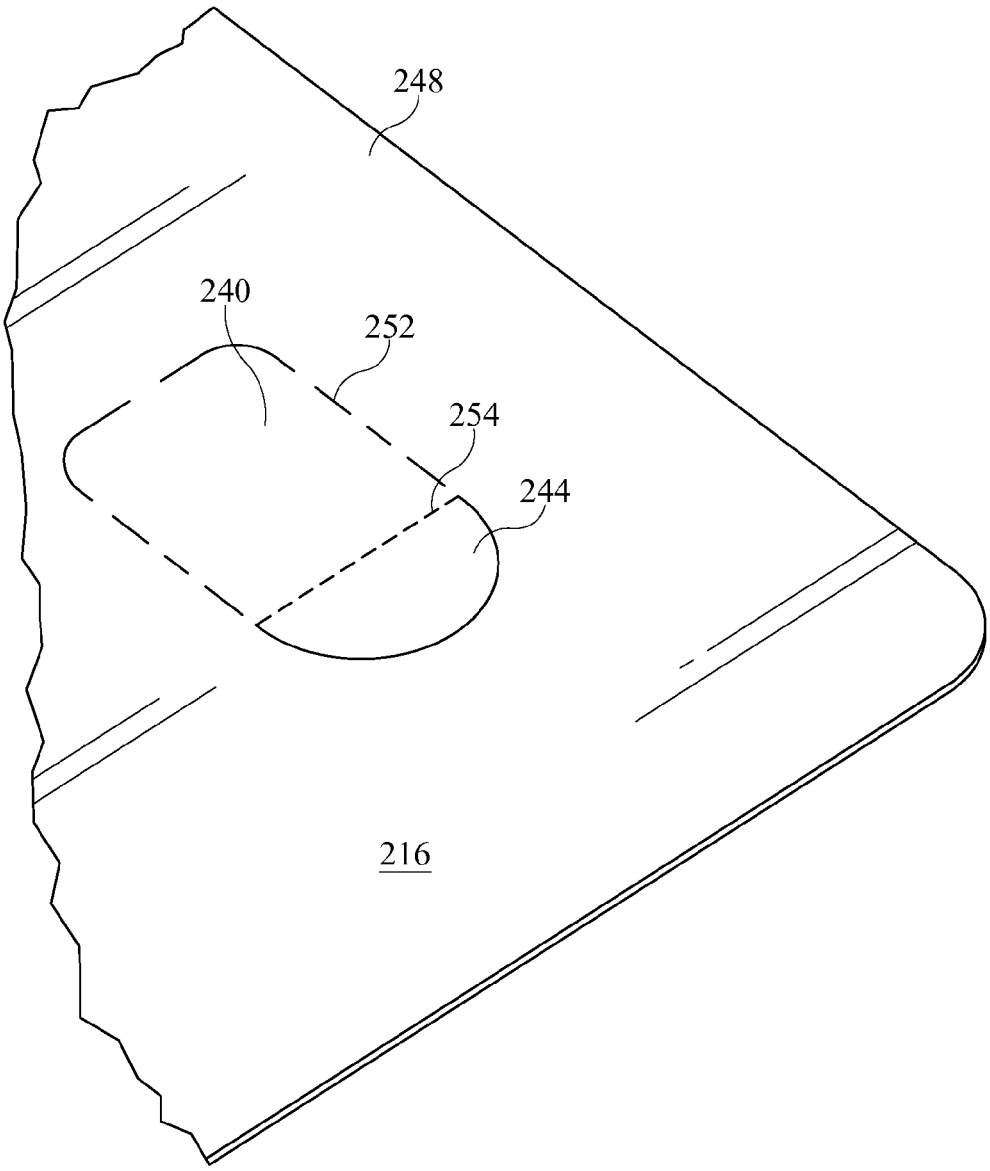
Figure 18:
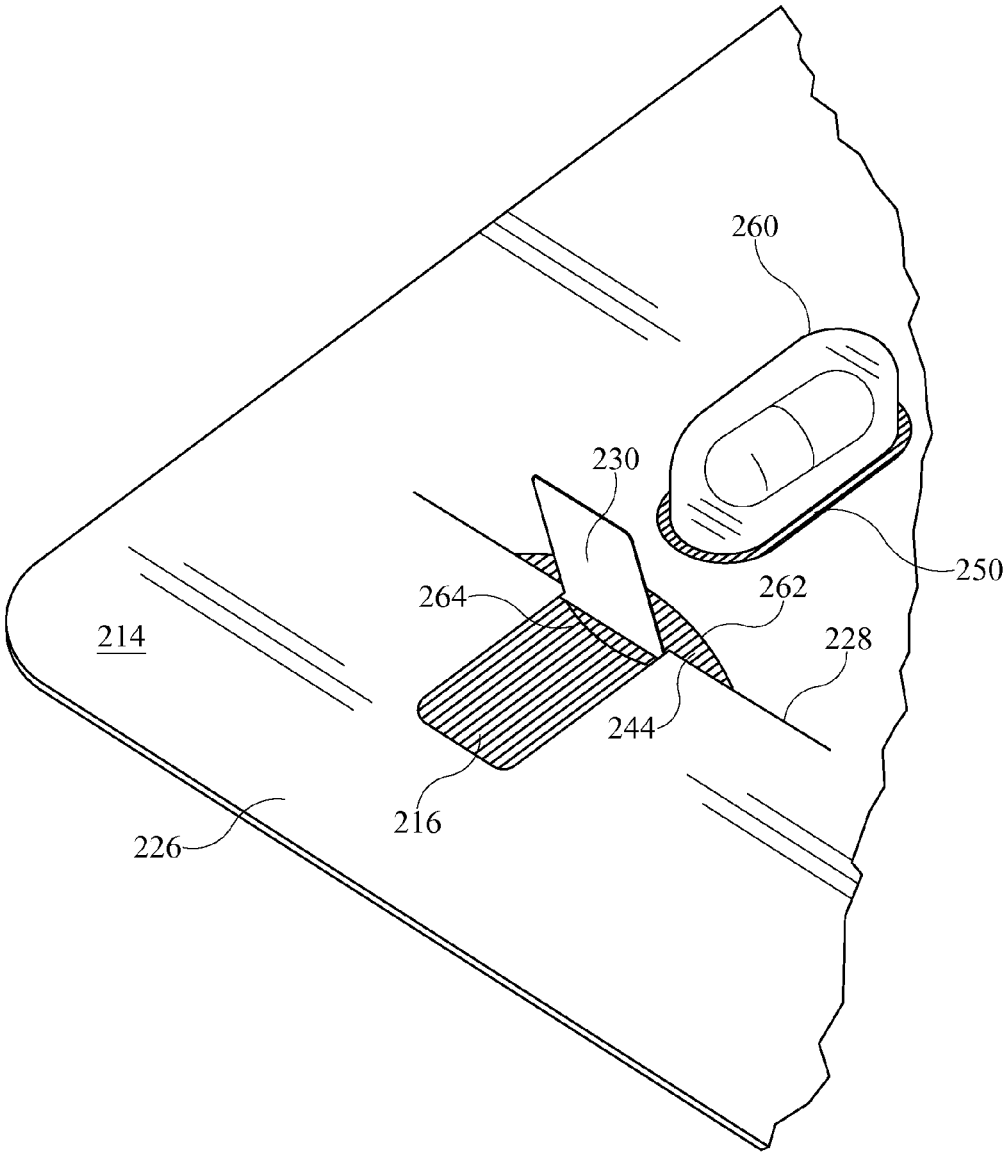
Figure 19:
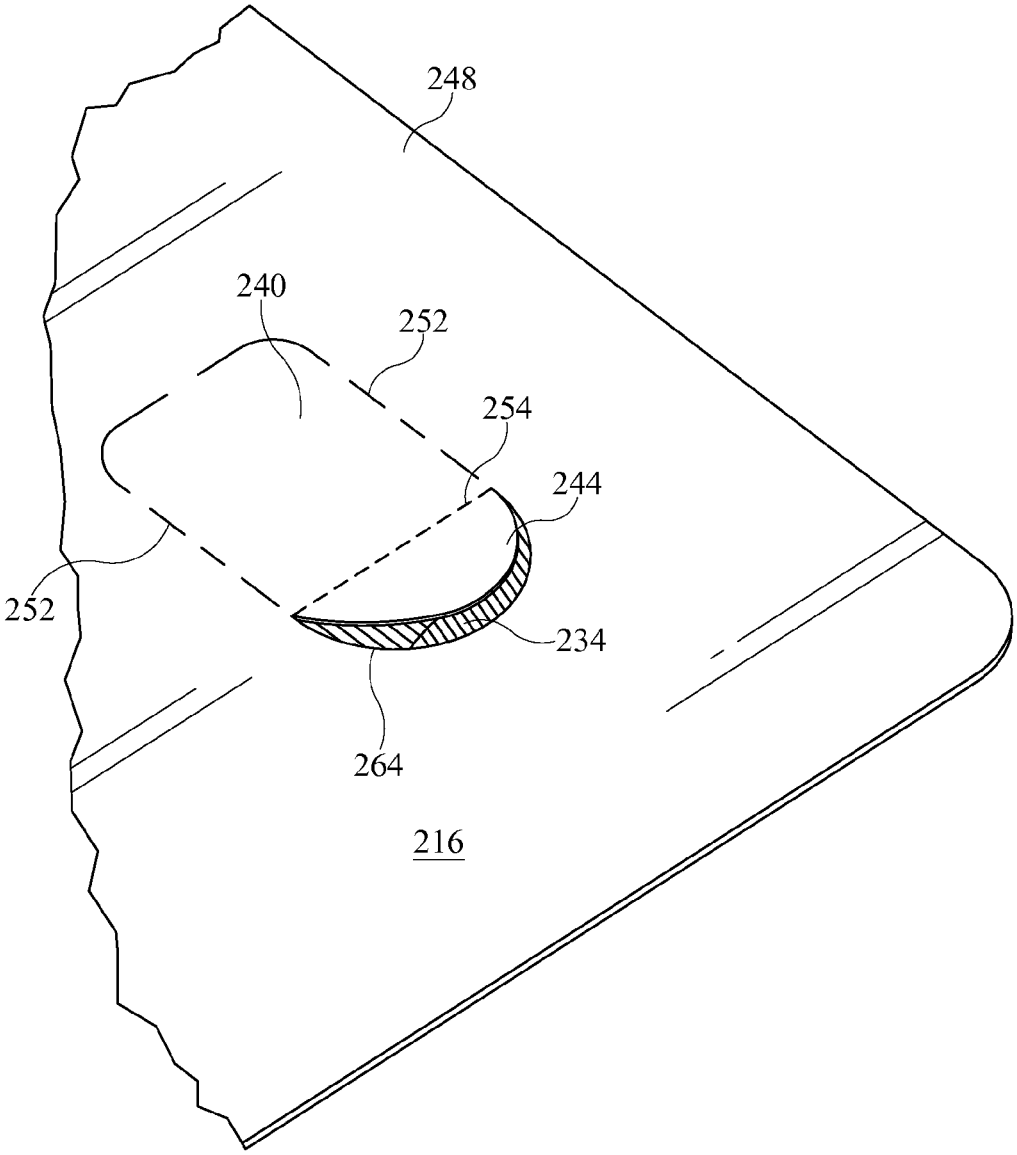

FIGS. 15-20 illustrate another example of a medication package 200. The package may have at least two panels partially sealed together. FIG. 15 shows the package having a tray or blister having one or more product container areas 260 sandwiched between the at least two panels. The top panel 214 has a cut out area 222 to receive and hold blister 260. Approximate to cut out area 222 is a tool portion comprised of an actuation tool portion 234 and a grasping end 230. Actuation tool portion 234 may be defined in part by an arc shaped severance line 262 such as a cut, slit, half cut or perforated line. The arc shaped severance line 262 may be replaced by any other similar severance line such as a partially rectangular shaped severance line, V-shaped severance line, or any other shaped severance line depending on manufacturing preferences. Actuation tool portion 234 may be connected to grasping end 230 at pivot fold line 228. Grasping end 230 may be adjacent to opening 232. Grasping end 230 may be defined at least in part by perforations or weakened lines 256 such as cuts, half-cuts , slits or perforations. To access blister 260, a user may grasp grasping end 230 and lift up which may cause grasping end 230 to tear along tear lines or weakened lines 256. The lifting-up motion of grasping end 230 may also cause the actuation tool portion 234 to sever along the severance line 262 and pivot downward on pivot fold line 228. Optionally or if necessary, a user may also press down on actuation tool portion 234 which may pivot downward on fold line 228. FIG. 18 shows a top view of grasping end 230, torn away from top panel 214 and actuation tool portion 234 pivoted down against bottom panel 216, in the area of pull tab 244. In FIG. 18, pull tab 244 is viewed through an opening that has been defined in top panel 214 by actuation tool portion 234 that has been pivoted down. In this condition, pull tab 244 has been moved somewhat out of the plane of bottom panel 216 as best illustrated in FIG. 19. In FIGS. 18 and 19, reference numeral "264" denotes the curved edge of an opening that has been defined in bottom panel 216 by pull tab 244 that has been moved out of the plane of bottom panel 216. As shown in FIG. 19, a blister access portion may comprise pull tab 244 and tab strip 240. Fold line 254 may connect pull tab 244 and tab strip 240. Tab strip 240 may be defined at least in part by perforations 252 that allow pull tab 244 and tab strip 240 to tear away from bottom panel 216. Once tab strip 240 is removed from bottom panel 216, a user may access the bottom of blister 260. Blister 260 may have a foil layer that must be broken to express the pill or product contained therein.

Pull tab 244 may overlap with actuation tool portion 234 such that downward pressure on actuation tool portion 234 may lift (or lower) pull tab 244 such that the user may grasp pull tab 244. An abhesive layer or an unsealed un-adheared area may be located on the bottom side or inside surface of top panel 214 encompassing grasping end 230, fold line 228, and/or actuation tool portion 234. An abhesive layer or an unsealed or un-adheared area may be located on the top side or inside surface of bottom panel 216 encompassing pull tab 244, fold line 254 and/or tab strip 240. When top panel 214 and bottom panel 216 are combined and attached together, grasping end 230, fold line 228, and/or actuation tool portion 234 may not be attached or adhered to pull tab 244, fold line 254 and/or tab strip 240. This selective sealing or attachment of the two panels may be done by selective heat sealing along the edges 226 and 248 of top panel 214 and bottom panel 216 respectively.

Figure 20:
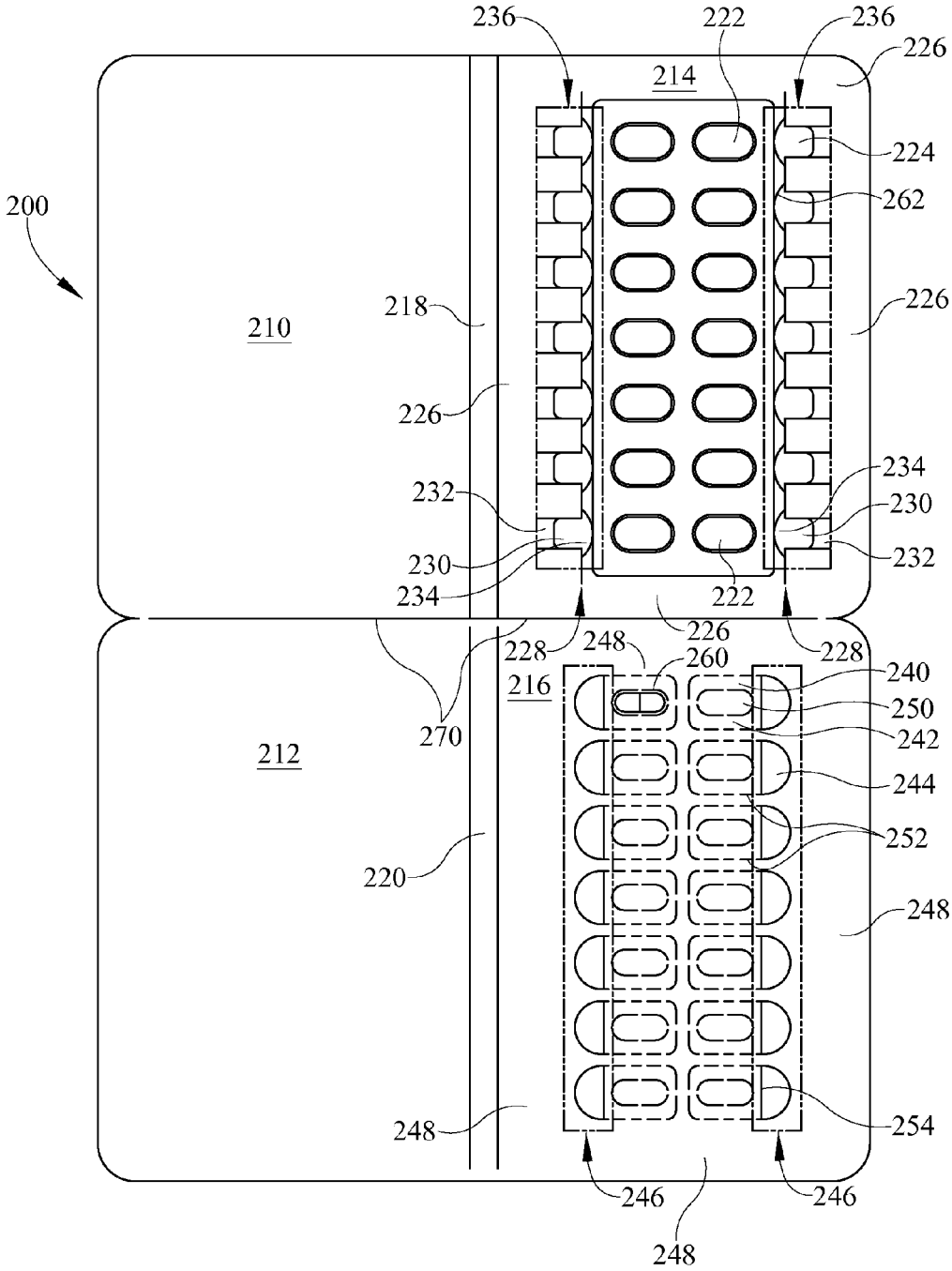
FIG. 20 illustrates the packaging blank that forms the package of FIG. 15.

In the alternative, selective application of an abhesive mixture in the areas described above may allow heat sealing to occur only around the outer edges 226 and 248 of top panel 214 and bottom panel 216. The abhesive mixture may be added to panels 214 and 216 over an adhesive layer that may be applied to the entire panel 214 and 216. In FIG. 20, the unattached/unsealed areas 236, 246 of the top panel 214 and bottom panel 216 are defined by the two-dot chain lines where the abhesive mixture may be applied or where selective heat sealing may not occur. Selective application of adhesive only around the outer edges 226 and 248 may also result in unsealed areas 236 and 246.

Package 200 may have one or more cover panels 210, 212. Inner cover panel 210 may be attached to spine panel 218 which may be attached to top tray panel 214. Outer cover panel 212 may be attached to spine panel 220 which may be attached to bottom tray panel 216. Fold line 270 may connect inner cover panel 210, spine panel 218, and top tray panel 214 to outer cover panel 212, spine panel 220, and bottom tray panel 216.

The term "abhesive" as used herein refers to a substance which prevents two materials sticking together. The term "abhesive" and all variations thereof (such as the terms "abhesion", "means for abhesion" and/or the like) if used herein should be readily understood by those skilled in the art as referring to the function and/or behavior of an abhesive that is substantially opposite to adhesion. Abhesion prevents the substantial adhering, bonding, binding, attaching or connecting of elements. Abhesive compositions and the chemical preparation thereof, as well as abhesive methods and the mechanical execution thereof, are known in the art. The abhesive mixture may be readily available in the market. The abhesive mixture may have a varnish component, a Teflon additive, and/or a UV solution component, it may have a wax component, one or more dryer compositions to help cure the solution, including but not limited a speedy dryer, it may have other suitable components and/or a mixture thereof. It may be heat curable, radio frequency curable, UV curable or curable by other such means as determined by manufacturing preferences.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

What is claimed is:

1. A packaging blank comprising:

a first panel having an inside surface, the first panel comprising at least one blister aperture and at least one tool portion; and a second panel for attachment along an inside surface thereof to the inside surface of the first panel, the second panel comprising at least one blister access portion comprising at least one tab strip and at least one pull tab, wherein:

the at least one tab strip is at least partially severable from the packaging blank; and the at least one pull tab is connected to the at least one tab strip;

wherein the at least one tool portion of the first panel partially overlaps with the at least one pull tab of the second panel when the second panel is placed for attachment to the first panel; and wherein the inside surface of the first panel comprised a first unsealed area for preventing substantial attaching of the first and second panels along the first unsealed area, the first unsealed area covering the at least one toll portion such that the at least one toll portion is not attached to the second panel when the first an second panels are attached together.

2. The packaging blank of claim 1, wherein the inside surface of the first panel is provided with a layer of adhesive, and the first unsealed area is provided by absence of the layer of adhesive at the first unsealed area.

3. The packaging blank of claim 1, wherein the inside surface of the first panel is provided with a layer of adhesive, and the first unsealed area is provided by a layer of adhesive over the layer of adhesive within the first unsealed area.

4. The packaging blank of claim 1, wherein the inside surface of the second panel comprises a second unsealed area for preventing substantial attaching of the first and second panels, the second unsealed area covering the at least one pull tab.

5. The packaging blank of claim 4, wherein the inside surface of the second panel is provided with a layer of adhesive, and the second unsealed area is provided by a layer adhesive over the layer of adhesive within the second unsealed area.

6. The packaging blank of claim 1, wherein the at least one tool portion comprises an actuation tool portion, a pivot region and a grasping end portion, and wherein the actuation tool portion overlaps with the at least one pull tab.

7. The packaging blank of claim 6, wherein the grasping end portion is adjacent to an open cut-out area.

8. A blister package housing comprising: a first panel having an inside surface, the first panel comprising at least one tool portion and at least one blister aperture; and a second panel comprising at least one blister access portion; and at least one blister pack comprising at least one blister for housing at least one product;

wherein:

the at least one blister of the at least one blister pack is aligned with the at least one blister aperture of the first panel; and the inside surface of the first and second panels are secured to one another such that the at least one tool portion and the at least one blister access portion partially overlap with one another, wherein the inside surface of the first panel comprises a first unsealed area for preventing substantial attaching of the first and second panels along the first unsealed area, the first unsealed area covering the at least one tool portion such that the at least one tool portion is not attached to the second panel.

9. The packaging blank of claim 4, wherein the inside surface of the second panel is provided with a layer of adhesive, and the second unsealed area is provided by absence of the layer of adhesive at the second unsealed area.

10. The packaging blank of claim 6, wherein the pivot region comprises a pair of spaced fold lines along which one of the actuation tool portion and the grasping end portion is connected to the first panel, the actuation tool portion and the grasping end portion being joined together through an area between the spaced fold lines, and the actuation tool portion and the grasping end portion extend in opposite directions from the area between the spaced fold lines to respective free ends thereof.

11. The packaging blank of claim 3, wherein the inside surface of the second panel comprises a second unsealed area for preventing substantial attaching of the first and second panels, the second unsealed area covering the at least one pull tab.

12. The packaging blank of claim 11, wherein the inside surface of the second panel is provided with a layer of adhesive, and the second unsealed area is provided by a layer of adhesive over the layer of adhesive within the second unsealed area.

13. The packaging blank of claim 11, wherein the inside surface of the second panel is provided with a layer of adhesive, and the second unsealed area is provided by absence of the layer of adhesive at the second unsealed area.

14. The blister package housing of claim 8, wherein the inside surface of the first panel is provided with a layer of adhesive, and the first unsealed area is provided by absence of the layer of adhesive at the first unsealed area.

15. The blister package housing of claim8, wherein the inside surface of the first panel is provided with a layer of adhesive, and the first unsealed area is provided by a layer of adhesive over the layer of adhesive within the first unsealed area.

16. The blister package housing of claim 8, wherein the inside surface of the first panel is provided with a layer of adhesive, and the first unsealed area is provided by selective heat sealing of the first and second panels excluding the first unsealed area.

17. The blister package housing of claim 8, wherein the inside surface of the second panel comprises a second unsealed area for preventing substantial attaching of the first and second panels, the second unsealed area covering the at least one pull tab.

18. The blister package housing of claim 17, wherein the inside surface of the second panel is provided with a layer of adhesive, and the second unsealed area is provided by a layer of adhesive over the layer of adhesive within the second unsealed area.

19. The blister package housing of claim 8, wherein the at least one tool portion comprises an actuation tool portion, a pivot region and a grasping end portion, and wherein the actuation tool portion overlaps with the at least one blister access portion.

20. The blister package housing of claim 19, wherein the pivot region comprises a pair of spaced fold lines along which one of the actuation tool portion and the grasping end portion is connected to the first panel, the actuation tool portion and the grasping end portion being joined together through an area between the spaced fold lines, and the actuation tool portion and the grasping end portion extend in opposite directions from the area between the spaced fold lines to respective free ends thereof.

* * * * *